US009988880B2

(12) United States Patent
Dykstra

(10) Patent No.: US 9,988,880 B2
(45) Date of Patent: Jun. 5, 2018

(54) SYSTEMS AND METHODS OF DRILLING CONTROL

(75) Inventor: Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 372 days.

(21) Appl. No.: 14/403,119

(22) PCT Filed: Jul. 12, 2012

(86) PCT No.: PCT/US2012/046361
§ 371 (c)(1),
(2), (4) Date: Nov. 21, 2014

(87) PCT Pub. No.: WO2014/011171
PCT Pub. Date: Jan. 16, 2014

(65) Prior Publication Data

US 2015/0105912 A1 Apr. 16, 2015

(51) Int. Cl.
*E21B 41/00* (2006.01)
*E21B 45/00* (2006.01)
(Continued)

(52) U.S. Cl.
CPC ..... *E21B 41/0092* (2013.01); *E21B 44/00* (2013.01); *E21B 45/00* (2013.01); *E21B 47/00* (2013.01)

(58) Field of Classification Search
CPC ..... E21B 44/00; E21B 47/12; E21B 49/003; E21B 2041/0028; E21B 44/005;
(Continued)

(56) References Cited

U.S. PATENT DOCUMENTS 4,165,789 A * 8/1979 Rogers ..... E21B 44/06 173/6
4,195,699 A * 4/1980 Rogers ..... E21B 44/00 173/177
(Continued)

FOREIGN PATENT DOCUMENTS

WO 01/79658 A1 10/2001
WO WO 0179658 A1 * 10/2001 ..... E21B 44/00
(Continued)

OTHER PUBLICATIONS

International Search Report and Written Opinion issued in related PCT Application No. PCT/US2012/046361 dated Apr. 11, 2013, 10 pages.

*Primary Examiner* — Robert Fennema
*Assistant Examiner* — Mohammed Shafayet
(74) *Attorney, Agent, or Firm* — Alan Bryson; Baker Botts L.L.P.

(57) ABSTRACT

A system to optimize a drilling parameter of a drill string includes a drill string control subsystem. The system includes an optimization controller to coordinate operations of the drill string control subsystem during a drilling process at least in part by: determining a first optimized rate of penetration based on a drilling parameter model and a first drilling parameter estimate; providing a first set of commands to the drill string control subsystem based on the first optimized rate of penetration; determining a second drilling parameter estimate during the drilling process based, at least in part, on the drilling parameter model and feedback corresponding to the drill string control subsystem; determining a second optimized rate of penetration during the drilling process based on the second drilling parameter estimate; and providing a second set of commands to the
(Continued)

drill string control subsystem based on the second optimized rate of penetration.

20 Claims, 10 Drawing Sheets

(51) Int. Cl.
*E21B 44/00* (2006.01)
*E21B 47/00* (2012.01)

(58) Field of Classification Search
CPC . E21B 3/02; E21B 44/02; E21B 44/04; E21B 41/0092; E21B 45/00; E21B 47/00; G05B 15/02
USPC ..... 700/275
See application file for complete search history.

(56) References Cited

U.S. PATENT DOCUMENTS 4,793,421 A * 12/1988 Jasinski ..... E21B 44/00 173/11
4,845,628 A * 7/1989 Gray ..... E21B 44/00 702/9
5,368,108 A * 11/1994 Aldred ..... E21B 44/005 175/40
5,842,149 A * 11/1998 Harrell ..... E21B 44/00 702/9
6,206,108 B1 * 3/2001 MacDonald ..... E21B 44/00 175/24
6,233,524 B1 * 5/2001 Harrell ..... E21B 7/068 702/9
6,293,356 B1 * 9/2001 King ..... E21B 3/02 175/27
6,408,953 B1 * 6/2002 Goldman ..... E21B 12/02 175/39
6,662,110 B1 * 12/2003 Bargach ..... E21B 44/00 175/45
6,879,947 B1 * 4/2005 Glass ..... E21B 10/00 175/48
7,054,750 B2 * 5/2006 Rodney ..... E21B 7/04 702/9
8,014,987 B2 * 9/2011 Pabon ..... E21B 44/00 703/10
2004/0256152 A1 * 12/2004 Dashevskiy ..... E21B 44/00 175/25
2005/0071120 A1 * 3/2005 Hutchinson ..... E21B 44/00 702/150
2005/0284661 A1 * 12/2005 Goldman ..... E21B 12/02 175/39
2008/0035378 A1 * 2/2008 Rock ..... E21B 43/305 175/57
2008/0255817 A1 * 10/2008 Pabon ..... E21B 44/00 703/10
2008/0262810 A1 * 10/2008 Moran ..... E21B 7/00 703/10
2010/0108384 A1 * 5/2010 Byreddy ..... E21B 44/00 175/27
2010/0193245 A1 * 8/2010 Glomsrud ..... E21B 44/00 175/45
2010/0259415 A1 * 10/2010 Strachan ..... E21B 44/00 340/853.6
2011/0174541 A1 * 7/2011 Strachan ..... E21B 44/00 175/27
2012/0059586 A1 * 3/2012 Itskovich ..... G01V 3/28 702/7
2012/0222900 A1 * 9/2012 Rodney ..... E21B 44/00 175/56
2012/0222901 A1 * 9/2012 Pei ..... E21B 49/003 175/56
2013/0032402 A1 * 2/2013 Byreddy ..... E21B 44/00 175/27
2013/0081880 A1 * 4/2013 Schwefe ..... E21B 10/00 175/327
2013/0341090 A1 * 12/2013 Zeineddine ..... E21B 7/00 175/24
2014/0116777 A1 * 5/2014 Wiercigroch ..... E21B 7/24 175/24
2014/0158428 A1 * 6/2014 Boone ..... E21B 7/24 175/40
2015/0105912 A1 * 4/2015 Dykstra ..... E21B 44/00 700/275

FOREIGN PATENT DOCUMENTS

WO 2010/039342 A1 4/2010
WO WO 2010039342 A1 * 4/2010 ..... E21B 44/00
WO WO 2010138718 A1 * 12/2010 ..... E21B 44/00

* cited by examiner

SYSTEMS AND METHODS OF DRILLING CONTROL

CROSS-REFERENCE TO RELATED APPLICATION

This application is a U.S. National Stage Application of International Application No. PCT/US2012/046361 filed Jul. 12, 2012, which is hereby incorporated by reference in its entirety.

BACKGROUND

The present disclosure relates generally to earth formation drilling operations and, more particularly, to systems and methods of drilling control.

In drilling operations, typical drilling processes are relatively complex and involve considerable expense. There is a continual effort in the industry to develop improvements in safety, cost minimization, and efficiency. Nonetheless, there remains a need to for more efficient, improved and optimized drilling processes.

BRIEF DESCRIPTION OF THE DRAWINGS

Some specific exemplary embodiments of the disclosure may be understood by referring, in part, to the following description and the accompanying drawings.

Figure 1A:
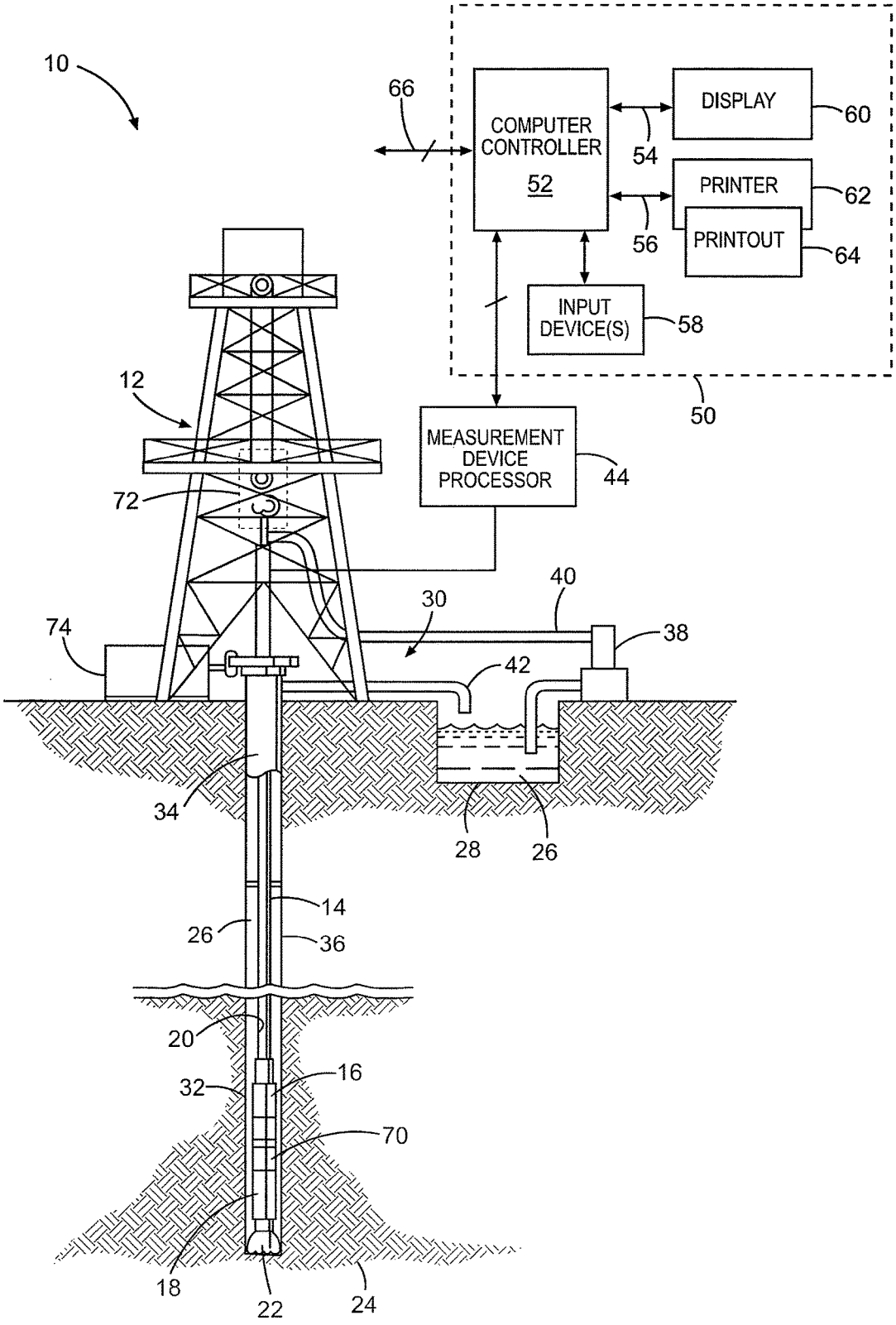
FIG. 1A is a diagram of a system, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to earth formation drilling operations and, more particularly, to systems and methods of drilling control.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

Certain embodiments of the present disclosure may be implemented at least in part with an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Certain embodiments of the present disclosure may be implemented at least in part with non-transitory computer-readable media. For the purposes of this disclosure, non-transitory computer-readable media may include any instrumentality or aggregation of instrumentalities that may retain data and/or instructions for a period of time. Non-transitory computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Certain embodiments of the present disclosure may provide for automatically controlling a drilling process. Certain embodiments may make all or a subset of decisions during a drilling process and may control one or more of a top drive, a draw works, and pumps. Certain embodiments may optimize a drilling process and provide command inputs to one or more drill string control subsystems. The optimization may be updated dependent on a drilling parameter model, which may include but not be limited to a bit model, as it changes with time. Certain embodiments may overcome non-linearities in a drilling process and remove or minimize them as needed.

FIG. 1A shows one non-limiting example drilling system 10, in accordance with certain embodiments of the present disclosure. The drilling system 10 may include a drilling rig 12 disposed atop a borehole 14. A logging tool 16 may be carried by a sub 18, typically a drill collar, incorporated into a drill string 20 and disposed within the borehole 14. A drill bit 22 is located at the lower end of the drill string 20 and carves a borehole 14 through the earth formations 24. Drilling mud 26 may be pumped from a storage reservoir pit 28 near the wellhead 30, down an axial passageway (not illustrated) through the drill string 20, out of apertures in the bit 22 and back to the surface through the annular region 32. Metal casing 34 may be positioned in the borehole 14 above the drill bit 22 for maintaining the integrity of an upper portion of the borehole 14.

The annular 32 between the drill stem 20, sub 18, and the sidewalls 36 of the borehole 14 forms the return flow path for the drilling mud. Mud may be pumped from the storage pit near the well head 30 by pumping system 38. The mud may travel through a mud supply line 40 which is coupled to a central passageway extending throughout the length of the drill string 20. Drilling mud is, in this manner, forced down the drill string 20 and exits into the borehole through apertures in the drill bit 22 for cooling and lubricating the drill bit and carrying the formation cuttings produced during the drilling operation back to the surface. A fluid exhaust conduit 42 may be connected from the annular passageway 32 at the well head for conducting the return mud flow from the borehole 14 to the mud pit 28.

The logging tool or instrument 16 can be any conventional logging instrument such as acoustic (sometimes referred to as sonic), neutron, gamma ray, density, photoelectric, nuclear magnetic resonance, or any other conventional logging instrument, or combinations thereof, which can be used to measure lithology or porosity of formations surrounding an earth borehole. The logging data can be stored in a conventional downhole recorder (not illustrated), which can be accessed at the earth's surface when the drill sting 20 is retrieved, or can be transmitted to the earth's surface using telemetry such as the conventional mud pulse telemetry systems. The logging data from the logging instrument 16 may be communicated to a surface measurement device processor 44 to allow the data to be processed for use in accordance with the embodiments of the present disclosure as described herein. In addition to MWD instrumentation, wireline logging instrumentation may also be used. The wireline instrumentation may include any conventional logging instrumentation which can be used to measure the lithology and/or porosity of formations surrounding an earth borehole, for example, such as acoustic, neutron, gamma ray, density, photoelectric, nuclear magnetic resonance, or any other conventional logging instrument, or combinations thereof, which can be used to measure lithology.

An information handling system 50 may be communicatively coupled to one or more components of the drilling system 10 in any suitable manner. The information handling system 50 may be configured to implement one or more of the embodiments described herein. The information handling system 50 may includes a device 52 that may include any suitable computer, controller, or data processing apparatus, further being programmed for carrying out the method and apparatus as further described herein. Computer/controller 52 may include at least one input for receiving input information and/or commands, for instance, from any suitable input device (or devices) 58. Input device (devices) 58 may include a keyboard, keypad, pointing device, or the like, further including a network interface or other communications interface for receiving input information from a remote computer or database. Still further, computer/controller 52 may include at least one output for outputting information signals and/or equipment control commands. Output signals can be output to a display device 60 via signal lines 54 for use in generating a display of information contained in the output signals. Output signals can also be output to a printer device 62 for use in generating a printout 64 of information contained in the output signals. Information and/or control signals 66 may also be output via any suitable means of communication, for example, to any device for use in controlling one or more various drilling operating parameters of drilling rig 12, as further discussed herein. In other words, a suitable device or means is provided for controlling a parameter in an actual drilling of a well bore (or interval) with the drilling system in accordance with certain embodiments described herein. For example, drilling system may include equipment such as one of the following types of controllable motors selected from a down hole motor 70, a top drive motor 72, or a rotary table motor 74, further in which a given rpm of a respective motor may be remotely controlled. The parameter may also include any other suitable drilling system control parameter described herein.

Computer/controller 52 may provide a means for generating a geology characteristic of the formation per unit depth in accordance with a prescribed geology model. Computer/controller 52 may provide for outputting signals on signal lines 54, 56 representative of the geology characteristic. Computer/controller 52 may be programmed for performing functions as described herein, using programming techniques known in the art. In one embodiment, a non-transitory computer-readable medium may be included, the medium having a computer program stored thereon. The computer program for execution by computer/controller 52 may be used to optimize a drilling parameter of the drill string in accordance with embodiments described herein. The programming of the computer program for execution by computer/controller 52 may further be accomplished using known programming techniques for implementing the embodiments as described and discussed herein.

Figure 1B:
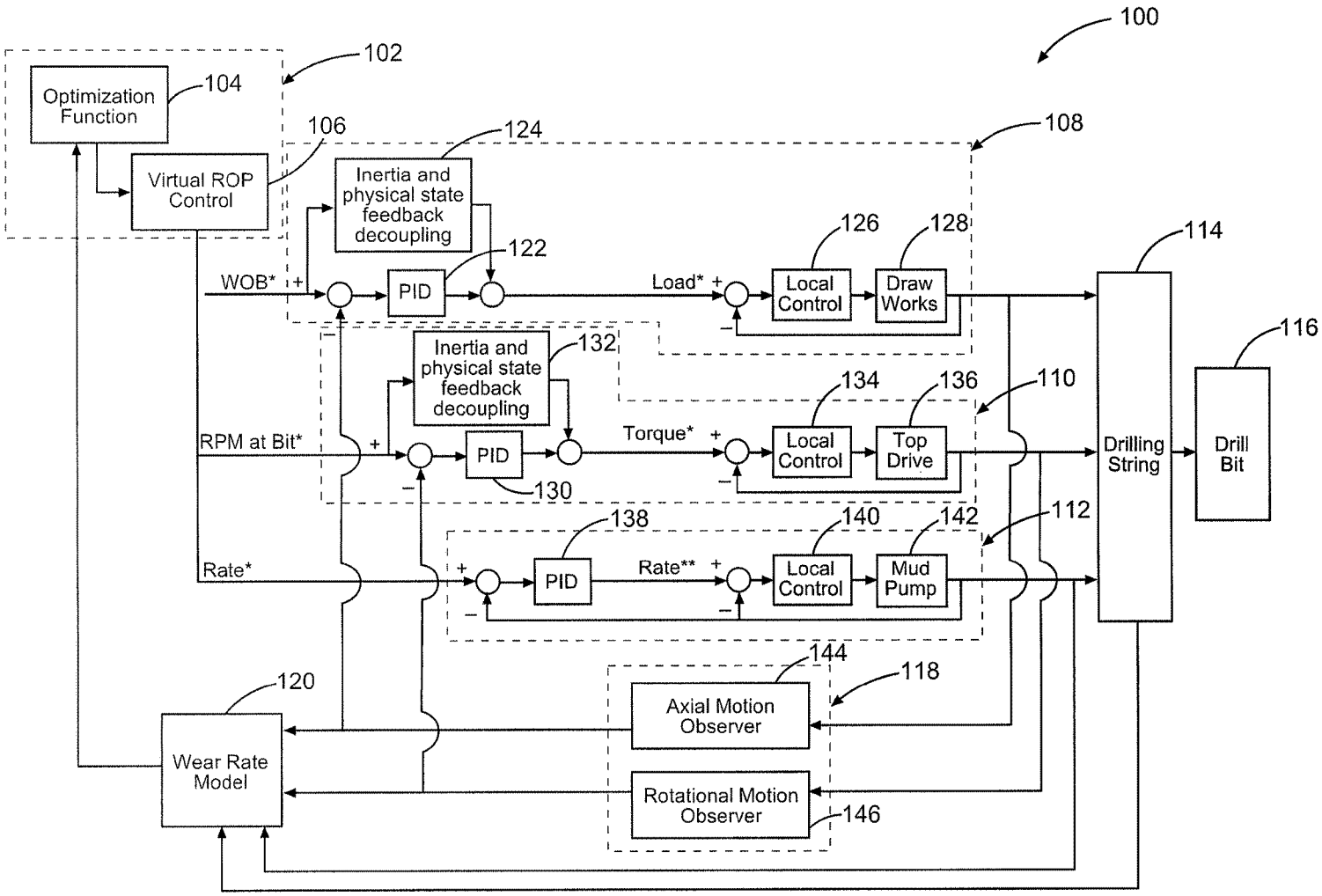
FIG. 1B is a diagram of a system, in accordance with certain embodiments of the present disclosure.

FIG. 1B is a diagram of a system 100, in accordance with certain embodiments of the present disclosure. In certain embodiments, the system 100 may provide for automatically controlling all or part of a drilling process. Thus, certain embodiments may make all decisions relating to all or part of a drilling process. In certain embodiments, the system 100 may control drilling equipment with purposes of minimizing cost and maximizing efficiency.

The system 100 may include an optimization controller 102. The optimization controller 102 may be communicatively coupled to one or more of a draw works control subsystem 108, a top drive control subsystem 110, and a pump control subsystem 112. The draw works control subsystem 108, top drive control subsystem 110, and/or pump control subsystem 112 may be communicatively coupled to a drill string 114, which may include a drill bit 116. One or more of the draw works control subsystem 108, top drive control subsystem 110, and/or pump control subsystem 112 may be communicatively coupled to a motion model 118. A drilling parameter model 120 may be communicatively coupled to one or more of the draw works control subsystem 108, top drive control subsystem 110, pump control subsystem 112, drill string 114, and optimization controller 102.

In certain embodiments, the optimization controller 102 may include one or both of an optimization function 104 and an ROP (rate of penetration) controller 106. The optimization controller 102 may be communicatively coupled to the ROP controller 106. The ROP controller 106 may be a virtual ROP controller and may be configured to keep a plurality of subsystems working in unison.

The optimization controller 102 may be configured to provide commands to one or more of the draw works control subsystem 108, top drive control subsystem 110, and/or pump control subsystem 112. The optimization controller 102 may be configured to coordinate operations of the draw works control subsystem 108, top drive control subsystem 110, and/or pump control subsystem 112. Providing commands may include the optimization controller 102 indicating one or more controller set points. For non-limiting example, the optimization controller 102 may provide a set point (represented by a signal WOB* in FIG. 1B) relating to a weight on bit (WOB) to the draw works control subsystem 108. The optimization controller 102 may provide a set point (represented by a signal RPM at Bit* in FIG. 1B) relating to a bit rate (such as the revolutions per minute at the bit 116) to the top drive control subsystem 110. The optimization controller 102 may provide set point (represented by a signal Rate* in FIG. 1B) relating to a pump rate to the pump control subsystem 112.

The draw works control subsystem 108 may include a PID (proportional-integral-derivative) controller 122 configured to receive an input based on the WOB* signal. For example, the PID controller 122 may be configured to receive a difference between the WOB* signal and a signal from the motion model 118. The draw works control subsystem 108 may include a decoupling function 124 that may be configured to provide inertia and/or physical state feedback decoupling. The decoupling function 124, for example, may have a feedforward configuration, as depicted, and may receive the WOB* signal. The draw works control subsystem 108 may include a local control 126. The local control 126 may receive a signal related to a load (Load*) from an output of the PID controller 122 and/or decoupling function 124. The local control 126 may have a negative feedback configuration, as depicted, that adjusts the input received based on the signal Load*. The local control 126 may directly or indirectly provide control signals to a draw works 128, which in turn may be operatively coupled to the drill string 114. The draw works 128 may include but not be limited to any suitable draw works or other load carrying system for drilling operations. Accordingly, the draw works control subsystem 108 may be configured to control any suitable draw works or other load carrying system for drilling operations. Use of the terms "draw works," "draw works control subsystem," or the like herein should not be understood to limit embodiments of the present disclosure to a draw works.

The top drive control subsystem 110 may include a PID controller 130 configured to receive an input based on the RPM at Bit* signal. For example, the PID controller 130 may be configured to receive a difference between RPM at Bit* signal and a signal from the motion model 118. The top drive control subsystem 110 may include a decoupling function 132 that may be configured to provide inertia and/or physical state feedback decoupling. The decoupling function 132, for example, may have a feedforward configuration, as depicted, and may receive the signal, RPM at Bit*. The top drive control subsystem 110 may include a local control 134. The local control 134 may receive a signal related to a torque (Torque*) from the PID controller 130 and/or decoupling function 132. The local control 134 may have a negative feedback configuration, as depicted, that adjusts the input received based on the signal, RPM at Bit*. The local control 134 may directly or indirectly provide control signals to a top drive 136, which in turn may be operatively coupled to the drill string 114.

The pump control subsystem 112 may include a PID controller 138 configured to receive an input based on the signal, Rate*. For example, the PID controller 138 may have a negative feedback configuration, as depicted, that adjusts the input received based on the signal, Rate*. The pump control subsystem 112 may include a local control 140. The local control 140 may receive a signal, Rate, from the PID controller 138. The local control 140 may directly or indirectly provide control signals to one or more pumps 142, which in turn may be operatively coupled to the drill string 114**.

The motion model 118 may include an axial motion model 144 and/or a rotational motion model 146. The axial motion model 144 may receive feedback from the draw works control subsystem 108. For example, the input may correspond to signals from one or more sensors (not shown) sensing axial motion associated with the draw works 128. The axial motion model 144 may reside within the draw works control subsystem 108 in certain embodiments. The rotational motion model 146 may receive feedback from the top drive control subsystem 110. For example, the input may correspond to signals from one or more sensors (not shown) sensing rotational motion associated with the top drive 136. The axial motion model 144 and/or rotational motion model 146 may include a lumped mass model, which may include springs configured to provide a dynamic model. As depicted, the axial motion model 144 and rotational motion model 146 provide feedback to the draw works control subsystem 108 and top drive control subsystem 110, as well as the drilling parameter model 120. The drilling parameter model 120 may model any suitable drilling parameter including but not limited to a drill bit, bit wear, and/or ROP as described further herein. In certain embodiments, the drilling parameter model 120 may model the rock-bit interaction and dynamics of the bottom hole assembly.

To provide command inputs for the top drive 136, draw works 128, and pumps 142, an optimization may be used. In accordance with certain embodiments of the present disclosure, the optimization controller 102 may be configured to perform the optimization. The optimization may take in account how performance may be affected by one or more of a WOB (weight on bit), a TOB (torque on bit), a RPM (revolutions per minute) of the drill bit 116, a flow rate ($\dot{V}$) generated by the one or more pumps 142, a wear on the drill bit 116, and a rock type through which the drill bit 116 may drill. The optimization may provide for optimization of ROP (rate of penetration). The optimization may be a stochastic non-linear problem with the ROP being a function of the input parameters including wear.

The ROP may be characterized by the following function.

$$ROP=f(WOB,TOB,RPM,\dot{V},wear)$$

The wear may be characterized by the following function.

$$\text{wear}=f(\text{WOB},\text{TOB},\text{RPM},\dot{V})$$

Initially, the ROP and wear functions may be defined. The functions may be updated as drilling is done.

Figure 2:
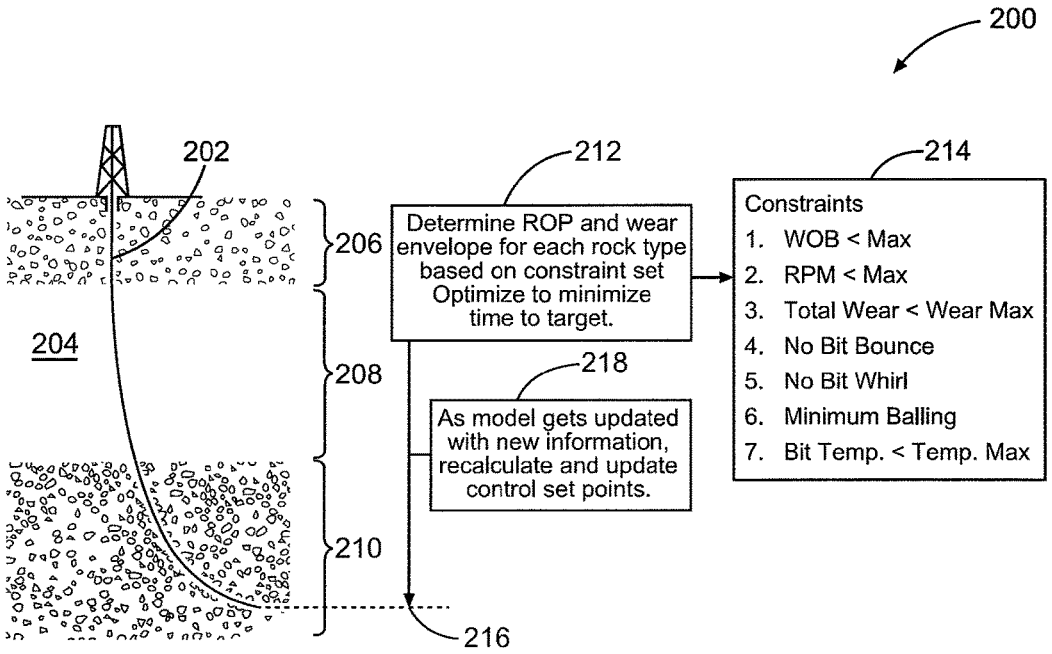
FIG. 2 is an example illustration of an optimization for drilling control, in accordance with certain embodiments of the present disclosure.

FIG. 2 is an example illustration of an optimization 200 for drilling control, in accordance with certain embodiments of the present disclosure. In certain embodiments, the optimization 200 may be implemented with the optimization function 104 of FIG. 1B and may optimize the ROP and the drilling control with respect to the ROP. As illustrated in FIG. 2, a drill path, or a proposed drill path, 202 may extend through a formation 204. The formation 204 includes multiple increasing depths, depth 206, depth 208, and depth 210, for example. Each of the depths 206, 208, 210 may correspond to one or more particular rock types. As generally indicated at 212, the ROP and wear may be determined for each rock type and/or depth 206, 208, 210. One or more rock properties may be defined or characterized by a probability function or a distribution. The optimization 200 may be solved using stochastic nonlinear, geometric, or dynamic programming. This can also be done using simulated annealing or genetic algorithms if multiple solutions exist.

Figure 3:
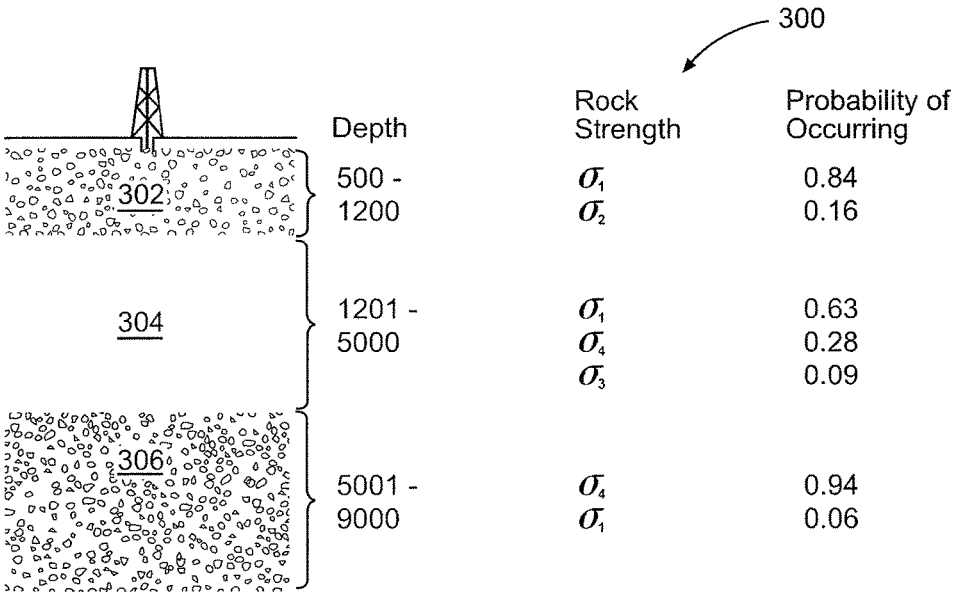
FIG. 3 is an example illustration of drilling in various rock types defined with probabilistic strength, in accordance with certain embodiments of the present disclosure.

FIG. 3 is an example illustration 300 of drilling in various rock types defined with probabilistic strength, in accordance with certain embodiments of the present disclosure. Rock type may be characterized as a probabilistic function of depth. As illustrated in the nonlimiting example, a formation may multiple increasing depths of a formation, such as depth 302, depth 304, and depth 306, may correspond to various depths relative to the surface or sea level. For each depth, various corresponding rock strength values may be identified along with probabilities of those rock strength values and associated rock types occurring. Rock type as a probabilistic function of depth may be included in input parameters for the optimization 200 and, for example, may be included in the ROP and/or wear determinations.

Figure 4:
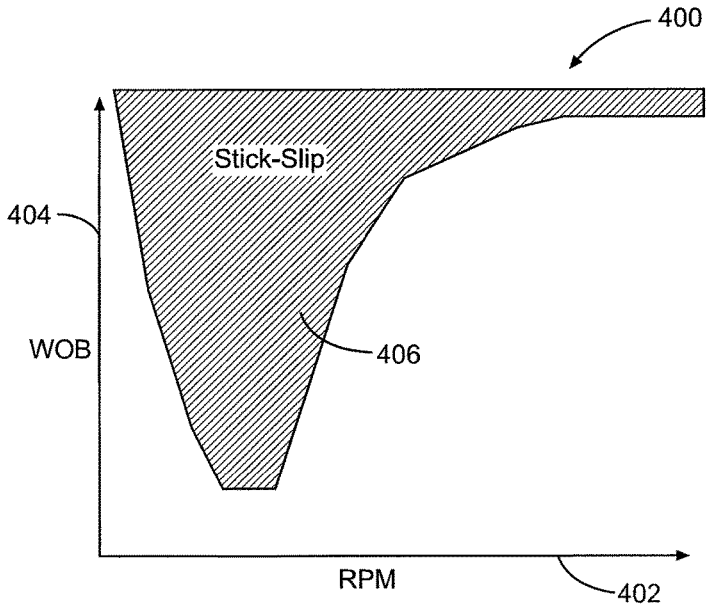
FIG. 4 depicts a graph drill string parameters with RPM (revolutions per minute) versus WOB (weight on bit), in accordance with certain embodiments of the present disclosure.

Referring again to FIG. 2, the determination of ROP and wear may be based, at least in part, on a constraint set 214. In certain embodiments, the constraint set 214 may include one or more of: (1) WOB<a maximum WOB; (2) RPM<a maximum RPM; (3) total wear<a maximum wear; (4) no bit bounce; (5) no bit whirl; (6) no or minimal bit balling; and (7) a bit temperature<a maximum bit temperature. Thus, the constraints may include that WOB and speed (RPM) must not cause unwanted vibrations. By way of example without limitation, FIG. 4 depicts a graph 400 of drill string parameters with RPM on an axis 402 versus WOB on an axis 404. Region 406 may represent points where stick-slip at the drill bit 116 may occur. As such, the region 406 may indicate WOB and RPM constraints to avoid unwanted vibrations.

Referring again to FIG. 2, the optimization 200 may use the ROP and wear functions above along with all or part of the constraint set 214 to obtain a WOB, RPM, flow rate, and bit type as a function of depth or time. One or more of these drilling parameters may be optimized to minimize a time to a target 216. As indicated at 218, the optimization 200 may be rerun when additional information is gained in the form of updated ROP and wear models or updated constraints. Control set points—for non-limiting example, set points represented by signals WOB*, RPM at Bit*, Rate* in FIG. 1B—may be updated based on the additional information. The optimization 200 may be extended to include bit types and bit replacement points by adding those variables into the optimization program, as described further herein.

Besides rock type, other quantities may also be represented as a probabilistic function, including the wear rate. For instance, to optimize cost, the ROP and wear may both be considered since wear affects ROP and determines when the drill bit 116 should be changed. Also, when the rock type changes, the minimal cost may be to take the time to change the drill bit 116 if the probabilistic rock type so indicates. To solve this problem, the optimization function 104 may utilize the following cost function:

$$F(Y)=\int f(\text{WOB},\dot{\phi},\text{RockType},\text{wear},\dot{V},\text{BitType})dt\ C_D+\Sigma f(\text{WOB},\dot{\phi},\text{RockType},\dot{V},\text{BitType})C_T+\Sigma C_B$$

where:

F=cost $\dot{\phi}$=RPM;

$\dot{V}$=flow rate;

$C_D$=cost of drill time;

$C_T$=cost of trip time; and $C_B$=cost of bits.

In this cost function, the controlled variables may include one or more of the set, X={WOB, $\dot{\phi}$, $\dot{V}$, BitType}. One or more of the controlled variables may depend on depth of drilling. The constraints may include that the flow rate must be maintained to move chips, as may characterized by the following.

$$\dot{V}\geq f(\text{WOB},\dot{\phi},\text{RockType},\text{BitType})$$

The cost may be in part a function of the drilling time, trip time, and bit costs. The cost of drilling may be a direct function of the time it takes to drill. Trip cost may be a function of the amount of trips, driven by the wear or bit changes to increase ROP. Bit costs may depend on how many and what type of bits to be used.

Figure 5:
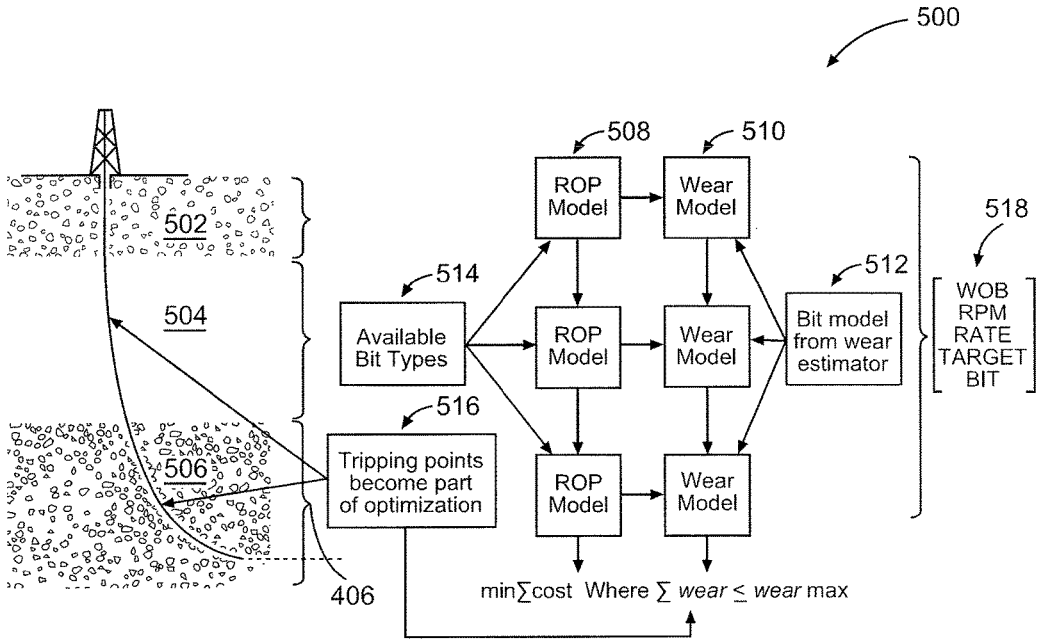
FIG. 5 is an example illustration of optimization for drilling control, in accordance with certain embodiments of the present disclosure.

FIG. 5 is an example illustration of optimization 500 for drilling control, in accordance with certain embodiments of the present disclosure. In certain embodiments, the optimization 500 may correspond to a variation of the optimization 200. For each of multiple formation depths, for example, depths 502, 504, and 506, one or more rock properties may be defined or characterized by a probability function or a distribution. For each of the depths 502, 504, and 506, drilling parameters models may be updated in view of minimizing cost under one or more the constraints described herein, including that the total wear be less than or equal to a maximum wear.

By way of non-limiting example, one or more of a ROP model 508, a wear model 510, and a bit model 512 may be updated. The ROP model 508 may provide input to the wear model 510, with each updated ROP model 508 providing corresponding updated input to the wear model 510. The wear model 510 may be updated with input from the bit model 512. The bit model 512 may be updated from the wear rate model 120 of FIG. 1B, and accordingly may be updated based on actual performance indicia of the drilling process.

In certain embodiments, the optimization 500 may specify bit types and/or bit replacement points by adding those variables into the optimization program. The ROP model 508 may take into account available bit types 514. Tripping points may be part of the optimization as indicated at 516, and changing tripping points may change acceptable wear rates and cost. Thus, the optimization 500 may use the ROP and wear functions along with constraints to obtain a WOB, RPM, flow rate, and bit type as a function of depth or time. The optimization 500 may be rerun when additional information is gained in the form of updated ROP model 508, wear model 510, and/or updated constraints.

The optimization 500 may produce a command vector 518 as function of time. In certain embodiments, the command vector 518 may include commands based, at least in part, on tripping points and/or bit types. By way of example without limitation, the command vector 518 may include commands regarding one or more of WOB, RPM, RATE, TARGET, and BIT. The optimization 500 may be rerun when changes warrant and may produce updated command vectors 518 accordingly.

Figure 6:
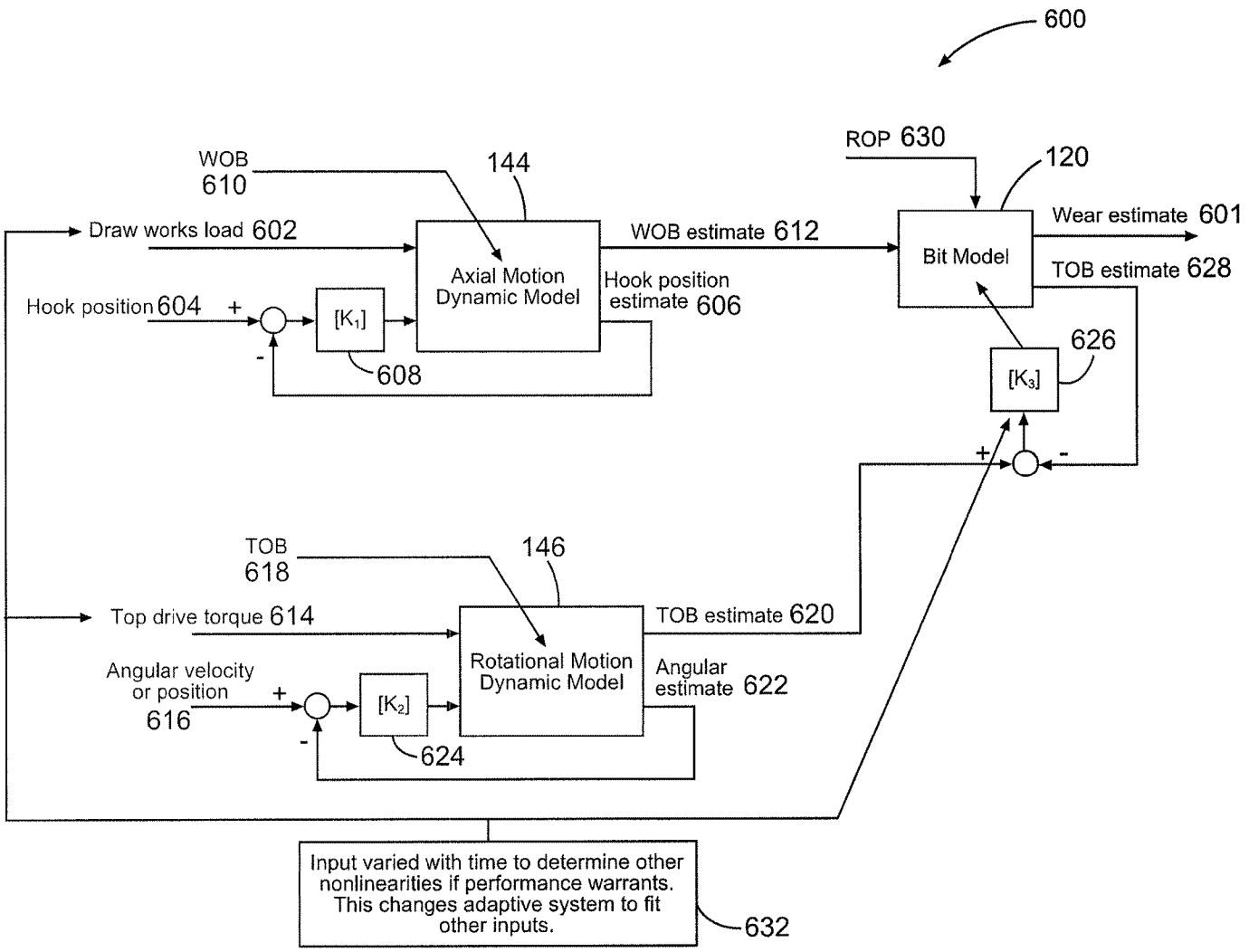
FIG. 6 is a diagram of a wear estimator, in accordance with certain embodiments of the present disclosure.

FIG. 6 shows a wear estimator 600, in accordance with certain embodiments of the present disclosure. The wear estimator 600 may be configured to estimate any suitable indication of wear, including but not limited to a wear rate and/or an extent of wear in the past, present, and/or future. The output of the wear estimator 600 may be a wear estimate 601 that may be provided to the optimization program, which for non-limiting example may correspond to an implementation of the optimization controller 102 and/or optimization function 104.

The wear estimator 600 may include an axial motion model 144 and/or the rotational motion model 146 communicatively coupled to the drilling parameter model 120. The axial motion model 144 and/or the rotational motion model 146 may be used to estimate a WOB and a TOB, respectively. With WOB and TOB estimates, the drilling parameter model 120 may be updated.

The axial motion model 144 may receive any suitable feedback, from the draw works 128, for example, that is indicative of a draw works load 602. The axial motion model 144 may also receive any suitable feedback that is indicative of a hook position 604. Calibration may be performed under free hanging state conditions in order to determine fictional effects. The axial motion model 144 may be updated with any suitable indications of WOB 610, if available. For non-limiting example, indications of WOB 610 may be provided by one or more downhole sensors on an intermittent or periodic basis. The axial motion model 144 may output a WOB estimate 612, which may be provided to the drilling parameter model 120.

The axial motion model 144 may determine a hook position estimate 606 and may have a negative feedback configuration, as depicted, that adjusts the input received based on the hook position 604 and the hook position estimate 600. The axial motion model 144 may be updated using an adaptive parametric controller 608 to improve accuracy of hook position determinations.

The rotational motion model 146 may receive any suitable feedback from the top drive 136, for example, that is indicative of a top drive torque 614. The rotational motion model 146 may also receive any suitable feedback that is indicative of an angular velocity or position 616. Calibration may be performed under free hanging state conditions in order to determine fictional effects. The rotational motion model 146 may be updated with any suitable indications of TOB 618, if available. For non-limiting example, indications of TOB 618 may be provided by one or more downhole sensors on an intermittent or periodic basis. The rotational motion model 146 may output a TOB estimate 620, which may be provided to the drilling parameter model 120.

The rotational motion model 146 may determine an angular estimate 622 and may have a negative feedback configuration, as depicted, that adjusts the input received based on the angular velocity or position 616 and the angular estimate 622. The rotational motion model 146 may be updated using an adaptive parametric controller 624 to improve accuracy of hook position determinations.

The drilling parameter model 120 may include a bit model and may be updated using an adaptive parametric controller 626 to improve accuracy of wear estimation. The drilling parameter model 120 may have a negative feedback configuration, as depicted, that adjusts the input received based on the TOB estimate 620 and a TOB estimate 628. The drilling parameter model 120 may receive any suitable indication of ROP 630, which may be provided from the drill string 114, for non-limiting example. In certain embodiments, for optimization, a stochastic model of the wear rate may be used based, at least in part, on historical data gained as the well is drilled and/or using historical data obtained from other wells. The TOB estimate 628 may be compared to the TOB estimate 620 of the rotational motion observer 146, and the bit model may be updated to force the bit model to converge on the estimate of the TOB estimate 620 of the rotational motion observer 146.

As indicated at 632, inputs may be varied with time to determine other nonlinearities if performance warrants, which may change the adaptive system to fit other inputs. Since there are more possible effects on ROP than wear, the system may also be used to predict those effects. Since the non-linearities of bit whirl, bit bounce, bit balling, and others behave differently over the operating space compared to each other and to bit wear, this method can be used to map most behaviors. In certain embodiments, the hook load and top drive rotational speed may be changed over time, and the weight on bit estimate, torque on bit estimate, and ROP may be used to map these other behaviors.

Figure 7:
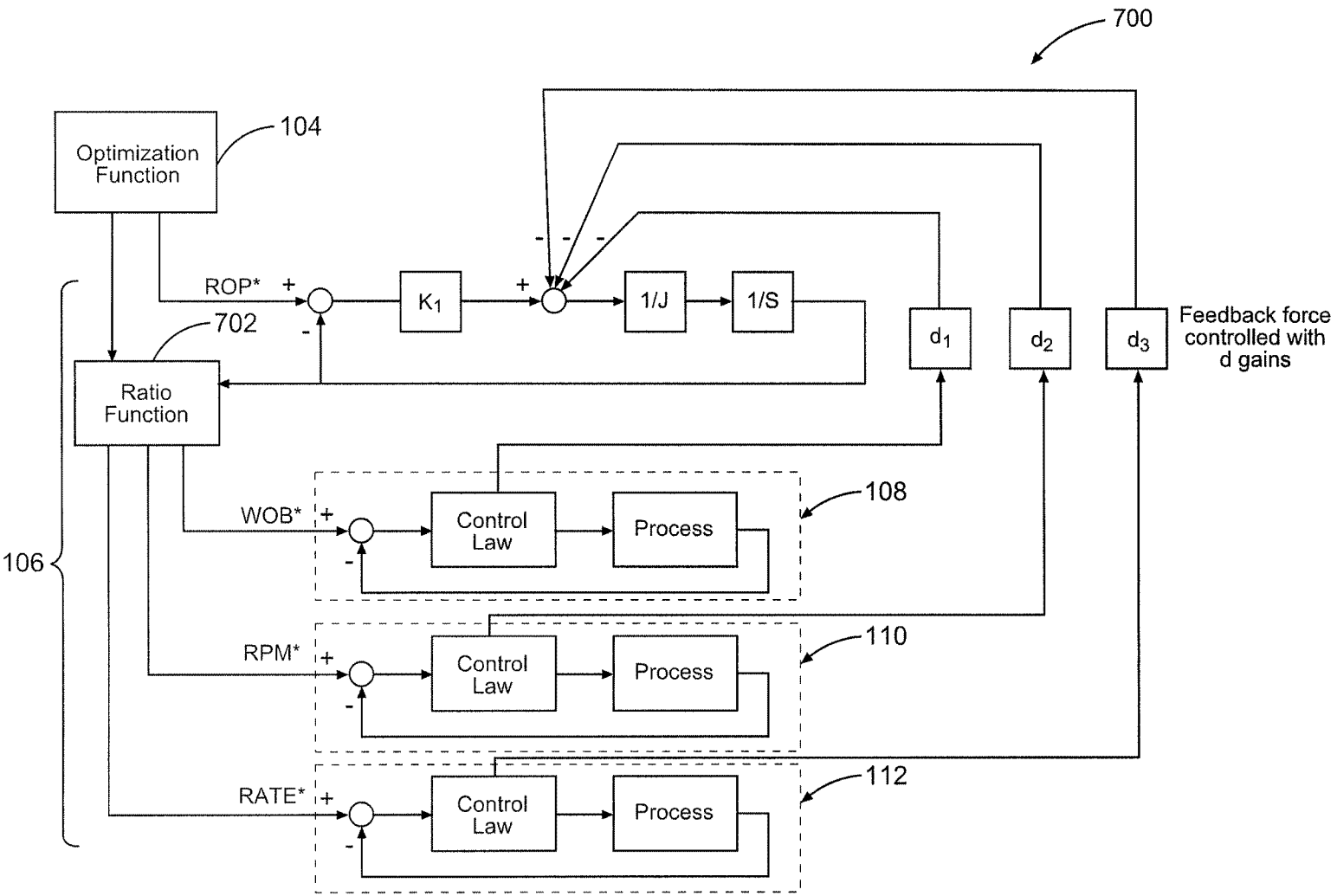
FIG. 7 is a diagram of a coupling control subsystem for drilling control, in accordance with certain embodiments of the present disclosure.

FIG. 7 illustrates a coupling control subsystem 700 for drilling control, in accordance with certain embodiments of the present disclosure. One purpose of the coupling control subsystem 700 may be to ensure all or a subset of the subsystems work in unison. By way of non-limiting example, the coupling control subsystem 700 may ensure that the draw works control subsystem 108, the top drive control subsystem 110, and the pump control subsystem 112 all work in unison. This may improve performance and reduce unwanted effects in the overall system 100.

The coupling control subsystem 700 may include the optimization function 104. The optimization function 104 may feed a desired rate ROP* to the ROP controller 106. The ROP controller 106 may include a virtual control system in certain embodiments. Based at least in part on the desired rate ROP*, the ROP controller 106 may provide a first order drive command augmented by proportional feedback through subsystem controllers. As depicted in the non-limiting example, ROP controller 106 may generate a first order drive based in part on gain $K_1$, feedback force controlled with d gains via $d_1$, $d_2$, $d_3$ and the subsystems 108, 110, 112, virtual inertia 1/J, integrator 1/S, and the feedback configuration depicted. This may be used to drive all the subsystems 108, 110, 112 in a virtual, computer-based implementation. The output of this virtual system may feed into a ratio function 702 of the ROP controller 106 to create the desired WOB, RPM at bit, and flow rate. As depicted, the WOB*, RPM*, and RATE* commands may be provided to the subsystems 108, 110, 112. These subsystems can feed back virtual force to the virtual ROP system and slow it down if one of the subsystems can not keep up with the current virtual ROP. This may ensure that all the subsystems 108, 110, 112 work together, that any subsystem bottleneck is not overrun, and that transitions are smooth. This may also reduce the likelihood that an unwanted behavior, such as bit balling, will occur since the subsystems 108, 110, 112 all work in unison.

Figure 8:
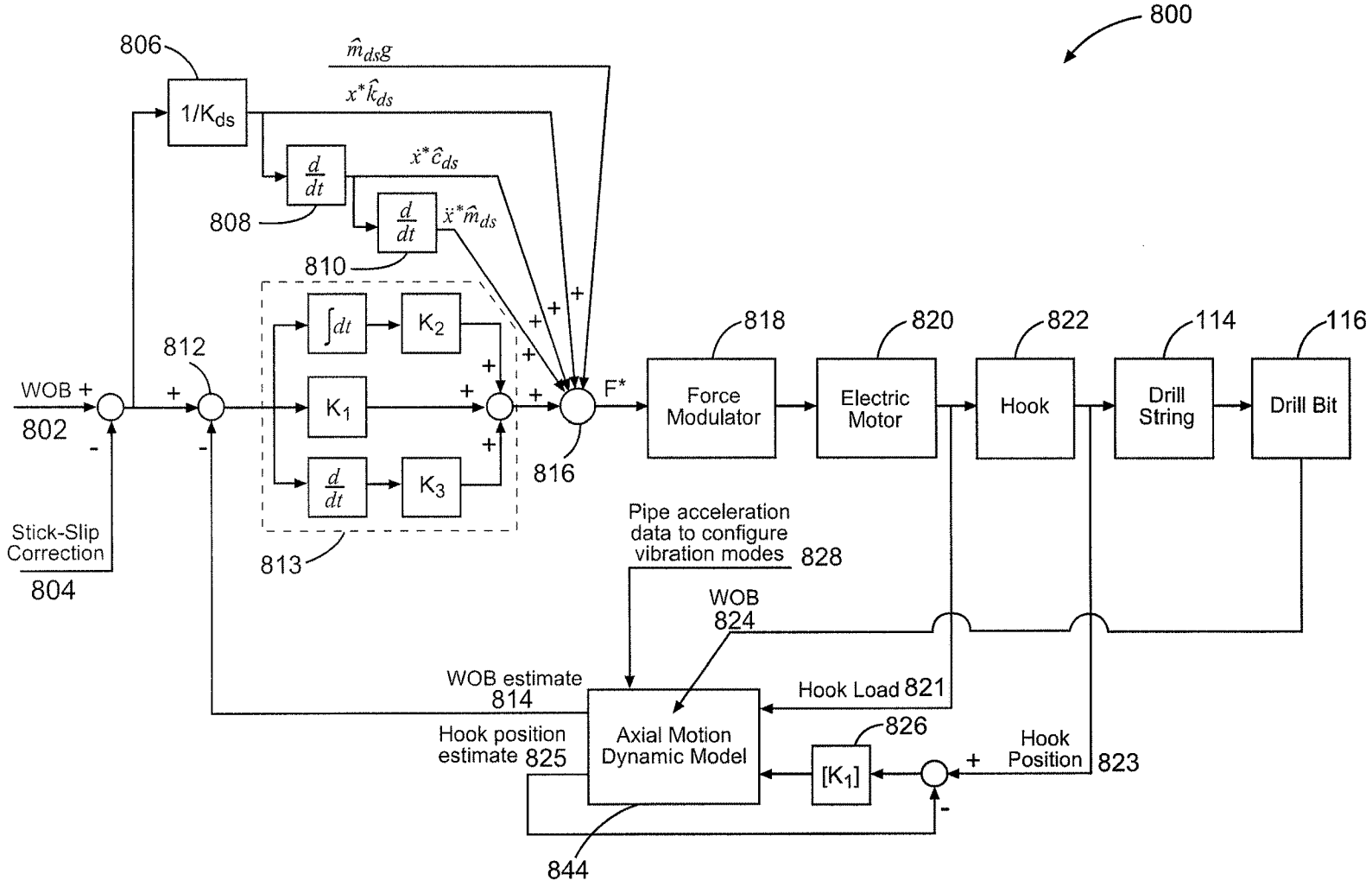
FIG. 8 is a diagram of a draw works control subsystem, in accordance with certain embodiments of the present disclosure.

FIG. 8 illustrates a draw works control subsystem 800, in accordance with certain embodiments of the present disclosure. In certain embodiments, the draw works control subsystem 800 may correspond at least in part to the draw works control subsystem 108 described in reference to FIG. 1B.

The draw works control subsystem 800 may provide WOB control based, at least in part, on feedback for a hook load 821 and/or a hook position 823 of a hook 822. In certain embodiments, the hook load 821 may correspond to the draw works load 602 previously described in reference to FIG. 6. The WOB set point 802 may be driven from one or more of the optimization controller 102, the optimization function 104, and the ROP controller 106. In certain embodiments, the WOB set point 802 may correspond to the WOB* command described in reference to FIG. 1B. As depicted in FIG. 8, the WOB set point 802 may be corrected by a stick-slip correction 804 if stick-slip behavior is detected. The stick-slip correction 804 may remove or minimize stick-slip oscillations. This correction will be further described later and may include input from the top drive 136.

The corrected WOB signal may then be fed into an inverse of a current estimated spring constant 806. Multiplication of the corrected WOB with the current estimated spring constant 806 and shown differentiation 808, 810 may produce vectors of position, velocity, and acceleration of the hook, as indicated. The position and velocity may be used to decouple the physical state feedback in the system by multiplying the estimated spring constant and damping, respectively. The acceleration term may be multiplied by an estimated system mass to overcome inertial effects and improve tracking. The estimate of the spring constant, damping, and mass can be done with an axial motion model 844. The model 844 can be used to determine the effective spring constant, damping and mass at any given time since the entire pipe may not be in motion due to the sticktion of the pipe. The other feed forward term $\hat{m}_{ds}g$ may be used to decouple the gravity forces.

A summation junction 812 may compare the corrected WOB with a WOB estimate 814 from the axial motion model 844. The result may then be fed into the controller 813, which may correspond to the PID controller 122 of FIG. 1B or any other suitable error correcting controller. In the presence of the feed forward terms, one purpose of the controller 813 may be to overcome inaccuracies in feed forward estimated terms. The controller 813 having this form may improve tracking and reduce effects of non-linearities in the system (reduce Eigen value migration). In certain embodiments, the axial motion model 844 may correspond to the axial motion model 144 described in reference to FIG. 1B. One reason that the axial motion model 844 may be used is that the WOB may not be able to be measured directly on a regular basis. If data is available on the WOB, it may be used to improve the axial motion model 844 through a parametric adaptive system.

A force signal F* may result from a junction 816. The force signal F* may be fed to a force modulator 818, which may in turn feed a modulated signal to a motor 820. The motor 820 may drive the hook 822, which in turn adjusts the drill string 114 and drill bit 116.

The axial motion model 844 may be updated with any suitable indications of WOB 824, if available. For non-limiting example, indications of WOB 824 may be provided on an intermittent or periodic basis by one or more downhole sensors placed about the drill bit 116 in any suitable manner. The axial motion model 844 may also receive any suitable feedback that is indicative of a hook position 823. Calibration may be performed under free hanging state conditions in order to determine fictional effects. The axial motion model 844 may determine a hook position estimate 825 and may have a negative feedback configuration, as depicted, that adjusts the input received based on the hook position 823 and the hook position estimate 825. The axial motion model 844 may be updated using an adaptive parametric controller 826 to improve accuracy of hook position determinations. As indicated at 828, the axial motion model 844 may be updated with pipe acceleration data to configure vibration modes.

Figure 9:
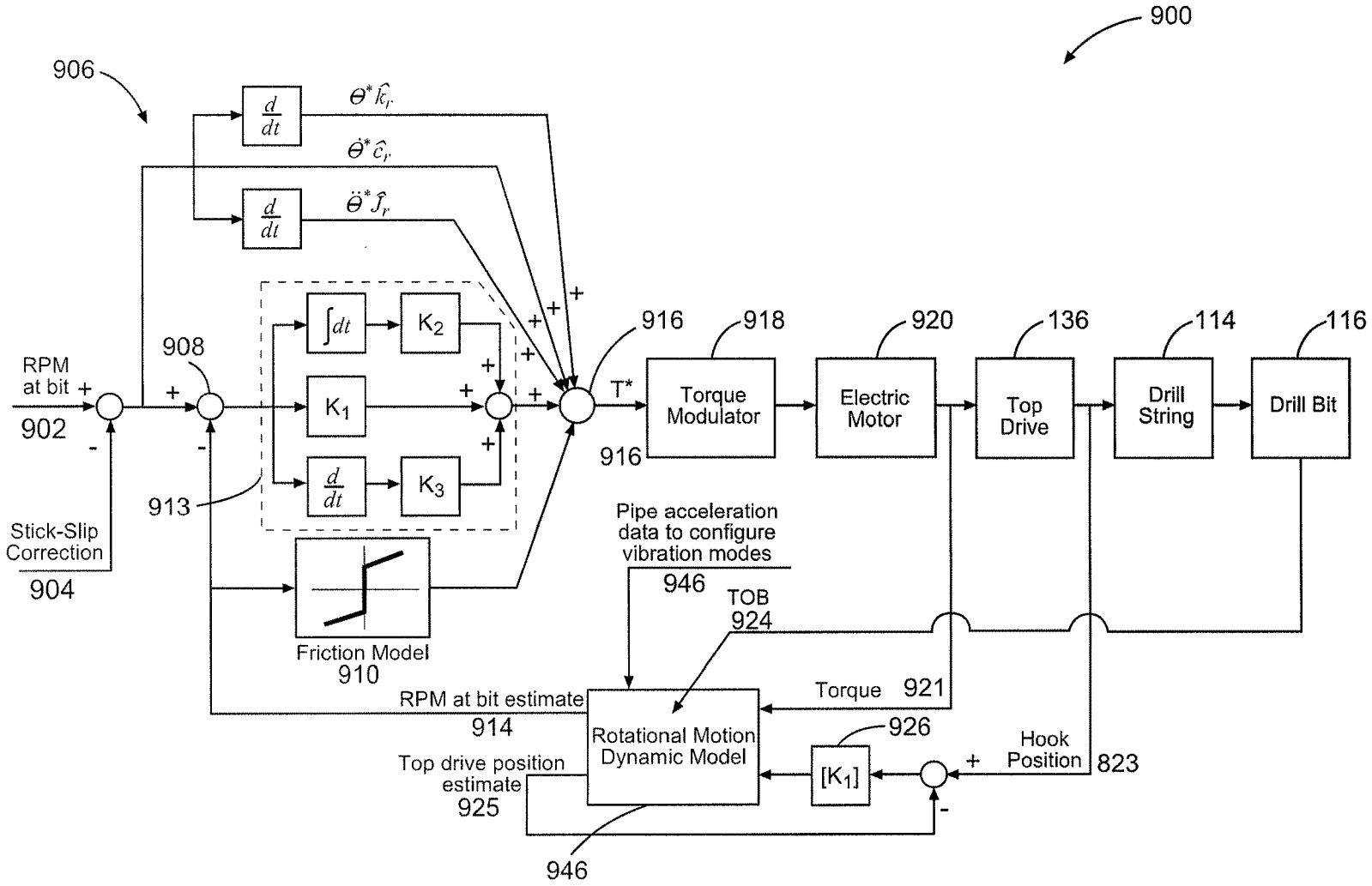
FIG. 9 is a diagram of a top drive control subsystem, in accordance with certain embodiments of the present disclosure.

FIG. 9 illustrates a top drive control subsystem 900, in accordance with certain embodiments of the present disclosure. In certain embodiments, the top drive control subsystem 900 may correspond at least in part to the top drive control subsystem 110 described in reference to FIG. 1B. The top drive control subsystem 900 may provide for control of the rotational speed of the drill bit 116 based, at least in part, on feedback for a torque 921 and/or a top drive position 923 of the top drive 136. The top drive control subsystem 900 may receive a RPM set point 902. In certain embodiments, the RPM set point 902 may be driven from one or more of the optimization controller 102, the optimization function 104, and the ROP controller 106 of FIG. 1B. In certain embodiments, the RPM set point 902 may correspond to the RPM at Bit* command described in reference to FIG. 1B. As depicted in FIG. 9, the RPM set point 902 may be corrected by a stick-slip correction 904 if stick-slip behavior is detected. The stick-slip correction 904 may remove or minimize stick-slip oscillations. This correction will be further described later.

The corrected RPM signal may correspond to a speed at the drill bit 116. The corrected RPM signal may be fed to feed forward terms 906 and a summation junction 908. The feed forward terms 906 may be designed to overcome the inertia for improved tracking, and to decouple the physical state feedback to reduce or remove their effects on the system dynamics.

The summation junction 908 may compare the corrected RPM signal with a RPM estimate 914 from a rotational motion model 946. The result may then be fed into the controller 913, which may correspond to the PID controller 130 of FIG. 1B or any other suitable error correcting controller. In the presence of the feed forward terms 906, one purpose of the controller 913 may be to overcome inaccuracies in feed forward estimated terms. The controller 913 having this form may improve tracking and reduce effects of non-linearities in the system (reduce Eigen value migration). In certain embodiments, the rotational motion model 946 may correspond to the rotational motion model 146 described in reference to FIG. 1B. One reason that the rotational motion model 946 may be used is that the speed may not be able to be measured directly on a regular basis. If data is available on the speed, it may be used to improve the rotational motion model 946 through a parametric adaptive system.

A non-linear friction decoupling 910 may be another feed forward and may include a model of bit friction, which is typically highly non-linear, can be used to reduce stick-slip phenomenon by feeding inverse torque inputs into junction 916 when it occurs. The ability to overcome the stick-slip may depend on the reaction time of the system, and may need to be avoided altogether under certain circumstances determined by the stick-slip compensation.

A torque signal T* may result from the junction 916. The torque signal T* may be fed to a torque modulator 918, which may in turn feed a modulated signal to a motor 920. The motor 920 may drive the top drive 136, which in turn adjusts the drill string 114 and drill bit 116.

The rotational motion model 946 may be used to provide the RPM at bit information if it is not measured directly. The rotational motion model 946 may be updated with any suitable indications of TOB (torque on bit) 924, if available. For non-limiting example, indications of TOB 924 may be provided on an intermittent or periodic basis by one or more downhole sensors placed about the drill string 114 and/or drill bit 116 in any suitable manner. The rotational motion model 946 may also receive any suitable feedback that is indicative of a top drive position 923. Calibration may be performed under free hanging state conditions in order to determine fictional effects. The axial rotational motion model 946 may determine a top drive position estimate 925 and may have a negative feedback configuration, as depicted, that adjusts the input received based on the top drive position 923 and the top drive position estimate 925. The rotational motion model 946 may be updated using an adaptive parametric controller 926 to improve accuracy of hook position determinations. As indicated at 928, the rotational motion model 946 may be updated with pipe acceleration data to configure vibration modes.

Figure 10:
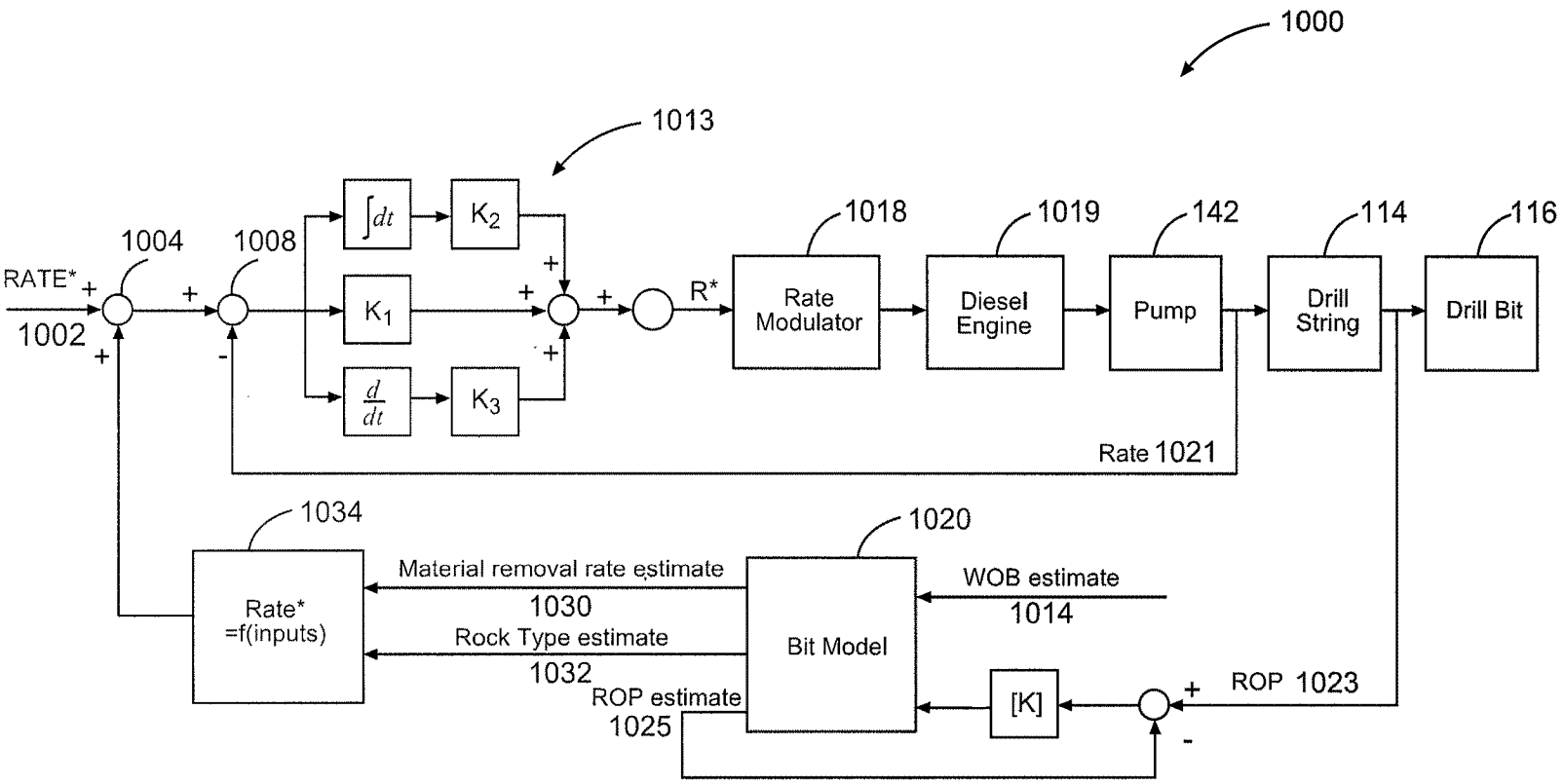
FIG. 10 is a diagram of a pump control subsystem, in accordance with certain embodiments of the present disclosure.

FIG. 10 illustrates a pump control subsystem 1000, in accordance with certain embodiments of the present disclosure. In certain embodiments, the pump control subsystem 1000 may correspond at least in part to the pump control subsystem 112 described in reference to FIG. 1B. The pump control subsystem 1000 may be designed to ensure that a pump rate is maintained during the drilling process. The pump control subsystem 1000 may provide for control of the pump 142 based, at least in part, on feedback for a rate 1021 of from the pump 142 and/or a ROP 923 of the drill string 114 and/or drill bit 116.

The pump control subsystem 1000 may receive a RATE* 1002. In certain embodiments, the RATE* 1002 may be from one or more of the optimization controller 102, the optimization function 104, and the ROP controller 106 of FIG. 1B. In certain embodiments, the RATE* 1002 may correspond to the Rate* command described in reference to FIG. 1B. As depicted in FIG. 10, the RATE* 1002 may be adjusted at junction 1004 by a correction coming from a drilling parameter model 1020. In certain embodiments, the drilling parameter model 1020 may correspond to the drilling parameter model 120, including the bit model, described previously. During certain behaviors, such as bit balling detection, the RATE* 1002 may be changed to compensate for this behavior by the use of the bit model feeding the correction function. The determination of the correction can be done using the bit model with direct feedback, a learning algorithm using historical data, or best practices such as included in a fuzzy logic system. In the example depicted, the drilling parameter model 120 may receive a WOB estimate 1014, which in certain embodiments may correspond to the WOB estimates 612, 814, described previously. The bit model 1020 may determine a ROP estimate 1025 and may have a negative feedback configuration, as depicted, that adjusts the input received based on the ROP 1023 and the ROP estimate 1025. The bit model 1020 may be updated using an adaptive parametric controller 1026 to improve accuracy of ROP determinations. The bit model 1020 may output a material removal rate estimate 1030 and/or a rock type estimate 1032. At 1034, the correction may be determined based, at least in part, on the material removal rate estimate 1030 and/or a rock type estimate 1032, and then fed to the junction 1004.

The corrected signal may be fed to junction 1008, where it may be adjusted with a suitable feedback configuration as illustrated based on the RATE 1021 from the pump 142. The result may be input to a controller 1013, which may correspond to the PID controller 138 of FIG. 1B or any other suitable controller. A rate signal R* may result from the controller 1013 and may be fed to a rate modulator 1018, which may in turn feed a modulated signal to an engine 1019. The engine 1019 may drive the pump 142, which in turn adjusts the flow rate for material removal from the drill string 114 and drill bit 116 downhole.

Figure 11:
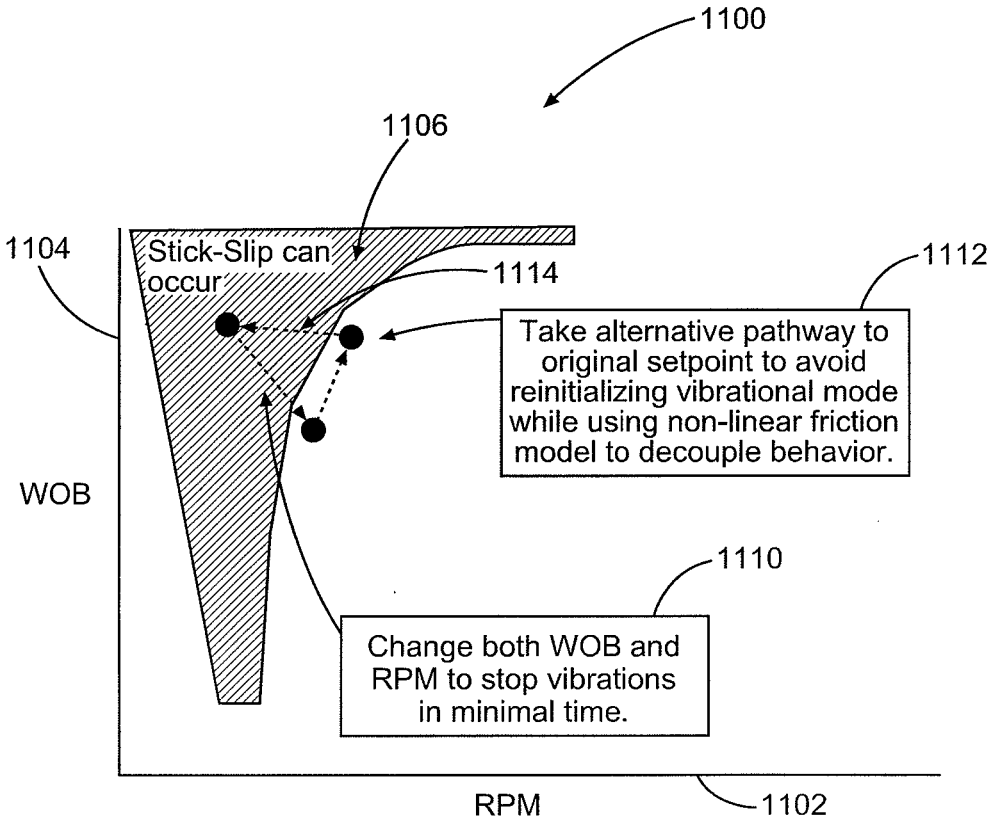
FIG. 11 illustrates stick-slip compensation, in accordance with certain embodiments of the present disclosure.

FIG. 11 illustrates stick-slip compensation 1100, in accordance with certain embodiments of the present disclosure. In the graph depicted, an axis 1102 represents RPM, an axis 1104 represents WOB, and region 1106 may represent points where stick-slip at the drill bit 116 may occur. A mode of vibration may sometimes be dependent on an approach to an operating condition which initializes a stable vibrational mode. As indicated by 1110, if the vibration occurs, the WOB and RPM at bit set points may be adjusted to take the drill string 114 out of this vibrational mode in minimal time. As indicated by 1112, after the vibrations are removed, the system 100 may attempt to return to the operating conditions but by a different pathway than what initialized the vibrations. The pathway 1114 may be determined by the dynamic models 144, 146, a learning algorithm using historical data, or best practices such as included in a fuzzy logic system. During this time, non-linear friction decoupling may be in operation and may also help to reduce the chance of reinitializing the vibrations. If the vibrations reappear the system 100 may attempt again to remove the vibrations, but by a different pathway if necessary. This can be attempted several times and, if this is unsuccessful, then the constraints in the optimization may be updated and the optimization may be rerun.

Accordingly, certain embodiments of the present disclosure may provide for more efficient, improved and optimized drilling processes. Certain embodiments may provide for automatically controlling a drilling process, for making all or a subset of decisions during a drilling process, and/or may optimize a drilling process. Certain embodiments may overcome non-linearities in a drilling process and remove or minimize them as needed.

Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward, higher, lower, and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While certain embodiments described herein may include some but not other features included in other embodiments, combinations of features of various embodiments in any combination are intended to be within the scope of this disclosure. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A system to optimize a drilling parameter of a drill string, the system comprising:

a drill string control subsystem; and an optimization controller to coordinate operations of the drill string control subsystem during a drilling process by:

determining a first optimized rate of penetration based at least on a drilling parameter model and a first drilling parameter estimate, wherein the drilling parameter model is based, at least in part, on a wear model, and wherein the wear model is a function of at least weight on bit (WOB), torque on bit, and revolutions per minute of a drill bit, wherein the drilling parameter model includes a bit model;

updating the bit model, based on a comparison of a first torque on bit estimate received from a rotational motion model and a second torque on bit estimate from the drilling parameter model, to force the bit model to converge on the first torque on bit estimate;

providing a first set of commands to the drill string control subsystem based, at least in part, on the first optimized rate of penetration;

determining a second drilling parameter estimate during the drilling process based at least on the drilling parameter model and feedback corresponding to the drill string control subsystem;

determining a second optimized rate of penetration during the drilling process based, at least in part, on the second drilling parameter estimate;

providing a second set of commands to the drill string control subsystem based, at least in part, on the second optimized rate of penetration, wherein the determining of at least one of the first optimized rate of penetration and the second optimized rate of penetration is based, at least in part, on a constraint set, wherein the constraint set comprises one or more drill string parameters, wherein the one or more drill string parameters comprise at least one of the WOB and the revolutions per minute of the drill bit, and wherein the constraint set defines a region where stick-slip at a drill bit of the drill string may occur; and controlling the drill string control subsystem based on the second set of commands.

2. The system of claim 1, wherein one or both of the first optimized rate of penetration and the second optimized rate of penetration are based at least on one or more of a rock characteristic, a bit type, a target time, a depth, and a cost determination.

3. The system of claim 1, further comprising:

an axial motion model to receive feedback corresponding to a draws works and a hook position, wherein the hook position is updated based on a comparison of a hook position estimate from the axial motion model and a hook position feedback;

wherein the second drilling parameter estimate is based, at least in part, on the axial motion model.

4. The system of claim 1, further comprising:

wherein, the rotational motion model receives feedback corresponding to a top drive and at least one of an angular velocity and an angular position, wherein the rotational motion model determines an angular estimate, and wherein the at least one of the angular velocity and the angular position are updated based on the angular estimate;

wherein the second drilling parameter estimate is based, at least in part, on the rotational motion model.

5. The system of claim 1, wherein the drilling parameter model is based, at least in part, on feedback corresponding to a pump.

6. The system of claim 1, wherein the optimization controller is further to coordinate operations of the drill string control subsystem during a drilling process by: making a cost determination based at least on minimization of costs corresponding to one or more of a drilling time, a trip time, and a bit cost, wherein the bit cost is based at least on one or more of a bit type and a number of bits.

7. The drilling control system of claim 1, wherein the drill string control subsystem comprises one or more of a draws works control subsystem to control a draw works, a top drive control subsystem to control a top drive, and a pump control subsystem to control a pump.

8. A non-transitory computer-readable medium having a computer program stored thereon to optimize a drilling parameter of a drill string, the computer program comprising executable instructions that cause a computer to:

determine a first optimized rate of penetration based at least on a drilling parameter model and a first drilling parameter estimate, wherein the drilling parameter model is based, at least in part, on a wear model, and wherein the wear model is a function of at least weight on bit (WOB), torque on bit, and revolutions per minute of a drill bit, wherein the drilling parameter model includes a drill bit model;

update the drill bit model, based on a comparison of a first torque on bit estimate received from a rotational motion model and a second torque on bit estimate from the drilling parameter model, to force the drill bit model to converge on the first torque on bit estimate;

provide a first set of commands for a drill string control subsystem based, at least in part, on the first optimized rate of penetration;

determine a second drilling parameter estimate during a drilling process based at least on the drilling parameter model and feedback corresponding to the drill string control subsystem;

determine a second optimized rate of penetration during the drilling process based, at least in part, on the second drilling parameter estimate;

provide a second set of commands for the drill string control subsystem based, at least in part, on the second optimized rate of penetration, wherein the determination of at least one of the first optimized rate of penetration and the second optimized rate of penetration is based, at least in part, on a constraint set, wherein the constraint set comprises one or more drill string parameters, wherein the one or more drill string parameters comprise at least one of the WOB and the revolutions per minute of the drill bit, and wherein the constraint set defines a region where stick-slip at a drill bit of the drill string may occur; and control the drill string control subsystem based on the second set of commands.

9. The non-transitory computer-readable medium of claim 8, wherein one or both of the first optimized rate of penetration and the second optimized rate of penetration are based at least on one or more of a rock characteristic, a bit type, a target time, a depth, and a cost determination.

10. The non-transitory computer-readable medium of claim 8, wherein the second drilling parameter estimate is based, at least in part, on an axial motion model, wherein the axial motion model receives as inputs a feedback corresponding to a draws works and a feedback corresponding to a hook position, wherein the hook position is updated based on a comparison of a hook position estimate from the axial motion model and the hook position.

11. The non-transitory computer-readable medium of claim 8, wherein the second drilling parameter estimate is based at least on the rotational motion model and feedback corresponding to a top drive and at least one of an angular velocity and an angular position, wherein the rotational motion model determines an angular estimate, and wherein the at least one of the angular velocity and the angular position are updated based on the angular estimate.

12. The non-transitory computer-readable medium of claim 8, wherein the drilling parameter model is based, at least in part, on feedback corresponding to a pump.

13. The non-transitory computer-readable medium of claim 8, wherein the computer program further comprises executable instructions that cause a computer to:

make a cost determination based at least on minimization of costs corresponding to one or more of a drilling time, a trip time, and a bit cost, wherein the bit cost is based at least on one or more of a bit type and a number of bits.

14. The non-transitory computer-readable medium of claim 8, wherein the drill string control subsystem comprises one or more of a draws works control subsystem to control a draw works, a top drive control subsystem to control a top drive, and a pump control subsystem to control a pump.

15. A method to optimize a drilling parameter of a drill string, the method comprising:

providing a drill string control subsystem; and providing an optimization controller to coordinate operations of the drill string control subsystem during a drilling process by:

determining a first optimized rate of penetration based at least on a drilling parameter model and a first drilling parameter estimate, wherein the drilling parameter model is based, at least in part, on a wear model, and wherein the wear model is a function of at least weight on bit (WOB), torque on bit, and revolutions per minute of a drill bit, wherein the drilling parameter model comprises a drill bit model;

updating the drill bit model, based on a comparison of a first torque on bit estimate received from a rotational motion model and a second torque on bit estimate from the drilling parameter model, to force the drill bit model to converge on the first torque on bit estimate;

providing a first set of commands to the drill string control subsystem based, at least in part, on the first optimized rate of penetration;

determining a second drilling parameter estimate during the drilling process based at least on the drilling parameter model and feedback corresponding to the drill string control subsystem;

determining a second optimized rate of penetration during the drilling process based, at least in part, on the second drilling parameter estimate;

providing a second set of commands to the drill string control subsystem based, at least in part, on the second optimized rate of penetration, wherein the determining of at least one of the first optimized rate of penetration and the second optimized rate of penetration is based, at least in part, on a constraint set, wherein the constraint set comprises one or more drill string parameters, wherein the one or more drill string parameters comprise at least one of the WOB and the revolutions per minute of the drill bit, and wherein the constraint set defines a region where stick-slip at a drill bit of the drill string may occur; and controlling the drill string control subsystem based on the second set of commands.

16. The method of claim 15, wherein one or both of the first optimized rate of penetration and the second optimized rate of penetration are based at least on one or more of a rock characteristic, a bit type, a target time, a depth, and a cost determination.

17. The method of claim 15, further comprising:

providing an axial motion model to receive feedback corresponding to a draws works and a hook position, wherein the hook position is updated based on a comparison to an estimate of the hook position from the axial motion model and the hook position;

wherein the second drilling parameter estimate is based, at least in part, on the axial motion model.

18. The method of claim 15, further comprising:

wherein the rotational motion model receives feedback corresponding to a top drive and at least one of an angular velocity and an angular position, wherein the rotational motion model determines an angular estimate, and wherein the at least one of the angular velocity and the angular position are updated based on the angular estimate;

wherein the second drilling parameter estimate is based, at least in part, on the rotational motion model.

19. The method of claim 15, wherein the optimization controller is further to coordinate operations of the drill string control subsystem during a drilling process by:

making a cost determination based at least on minimization of costs corresponding to one or more of a drilling time, a trip time, and a bit cost, wherein the bit cost is based at least on one or more of a bit type and a number of bits.

20. The method of claim 15, wherein the drill string control subsystem comprises one or more of a draws works control subsystem to control a draw works, a top drive control subsystem to control a top drive, and a pump control subsystem to control a pump.

* * * * *